US006209985B1

(12) United States Patent
Minamizawa

(10) Patent No.: US 6,209,985 B1
(45) Date of Patent: Apr. 3, 2001

(54) RECORDING APPARATUS AND MEMORY MEDIUM

(75) Inventor: Fumihiro Minamizawa, Toyoaka (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/271,151

(22) Filed: Mar. 17, 1999

(30) Foreign Application Priority Data

Mar. 17, 1998 (JP) ..... 10-089250

(51) Int. Cl.[7] ..... B41J 2/15
(52) U.S. Cl. ..... 347/40; 347/43
(58) Field of Search ..... 347/40, 41, 43, 347/12, 14, 15, 69; 358/412, 85

(56) References Cited

U.S. PATENT DOCUMENTS

| | | | | |
|---|---|---|---|---|
| 4,803,500 | * | 2/1989 | Milbrandt | 347/43 |
| 4,879,568 | | 11/1989 | Bartky et al. | 347/69 |
| 4,887,100 | | 12/1989 | Michaelis et al. | 347/69 |
| 4,953,196 | * | 8/1990 | Ishikawa et al. | 379/53 |
| 4,992,808 | | 2/1991 | Bartky et al. | 347/69 |
| 5,003,679 | | 4/1991 | Bartky et al. | 347/69 |
| 5,028,936 | | 7/1991 | Bartky et al. | 347/69 |
| 5,371,531 | * | 12/1994 | Rezanka et al. | 347/43 |
| 5,825,508 | * | 10/1998 | Mukai | 358/412 |

FOREIGN PATENT DOCUMENTS 63-247051 10/1988 (JP) .

* cited by examiner

*Primary Examiner*—N. Le
*Assistant Examiner*—Lamson D. Nguyen
(74) *Attorney, Agent, or Firm*—Oliff & Berridge, PLC

(57) ABSTRACT

A recording apparatus uses a first recording head capable of recording in black on a recording medium, and a second recording head capable of recording in black on the recording medium at a recording speed that is lower than a recording speed of the first recording head. The second recording head and the first recording head are interchangeably mountable in the recording apparatus. A detection device detects which one of the first recording head and the second recording head is set. If the detection device detects that the second recording head is set, a storage device stores information received from an external device. For example, if a CPU detects reception of a CALL signal from an external facsimile, and detects a head detection flag indicating that a 6-color recording head having a lower black recording speed has been set, the CPU stores the facsimile data from the external facsimile into a RAM, thereby eliminating the problems involved if the slow 6-color recording head were to be used to immediately record the received facsimile data.

22 Claims, 10 Drawing Sheets

RECORDING APPARATUS AND MEMORY MEDIUM

BACKGROUND OF THE INVENTION

1. Field of the Invention

The invention relates to a recording apparatus, represented by a facsimile apparatus, and to a memory medium storing a computer program for controlling the recording apparatus, which solve problems associated with a recording head whose monochrome recording speed is lower than that of a monochrome recording-dedicated head, for example, a color recording-dedicated head.

2. Description of the Related Art

A known facsimile apparatus has a color printer function to perform color recording on a recording sheet by using, for example, an ink jet head.

Such a facsimile apparatus employs a black recording-dedicated head for recording only in black ink and a color recording-dedicated head unit for recording in color inks, that is, cyan, magenta, yellow and black inks. Either black recording using the black recording-dedicated head or color recording using the color recording-dedicated unit can be selected.

The aforementioned color recording-dedicated head unit has separate heads for the individual color inks, where each nozzle is allotted specifically to one of the color inks. Therefore, the color recording-dedicated head has fewer nozzles for ejecting black ink than the black recording-dedicated head, in which all the nozzles are provided for ejecting black ink.

As a result, the color recording-dedicated head has a lower recording speed in black recording than the black recording-dedicated head.

If the facsimile apparatus receives facsimile data when the color recording-dedicated head has been mounted, the facsimile data recording speed is naturally lower than the speed achievable when the black recording-dedicated head has been mounted, so that the recording may become unable to keep up with the communication speed, resulting in a transmission error in the sender facsimile apparatus. The cause of the transmission error is difficult to recognize by a person on the sender side.

The transmission error can be prevented by increasing the memory capacity for storing facsimile data. However, this measure considerably increases the production cost of the facsimile apparatus.

SUMMARY OF THE INVENTION

Accordingly, it is an object of the invention to provide a recording apparatus and a memory medium that solve the aforementioned problem by determining whether a recording head having a low black recording speed has been set.

According to one aspect of the invention, there is provided a recording apparatus including a first recording head capable of recording in black on a recording medium, and a second recording head capable of recording in black on the recording medium at a recording speed that is lower than a recording speed of the first recording head. The second recording head and the first recording head are interchangeably mountable in the recording apparatus. The recording apparatus further includes a detection device that detects which one of the first recording head and the second recording head is set, and an indication device that indicates a detection result provided by the detection device.

The detection device detects which one of the first recording head for recording in black on a recording medium and the second recording head for recording in black on a recording medium at a recording speed that is lower than a recording speed of the first recording head is set in the recording apparatus. The result of the detection performed by the detection device is indicated by the indication device.

Therefore, on the basis of the indication made by the indication device, a user of the recording apparatus can realize which one of the first recording head and the second recording head is mounted in the recording apparatus. If the second recording head is mounted in a facsimile apparatus to which the invention is applied, the indication device indicates to a user that the second recording head is mounted, so that when the facsimile apparatus is about to receive facsimile transmissions, the user can replace the second recording head to use the first recording head. In this manner, the recording apparatus of the invention avoids the problem that use of a recording head of a low recording speed to record received facsimile data causes the external device to have a transmission error, the cause of which is unknown to a user of the external device.

According to another aspect of the invention, there is provided a memory medium storing a computer program for controlling a recording apparatus including a first recording head capable of recording in black on a recording medium, and a second recording head capable of recording in black on the recording medium at a recording speed that is lower than a recording speed of the first recording head, the second recording head and the first recording head being interchangeably mountable in the recording apparatus. The computer program stored in the memory medium includes a recording head detection program for detecting which one of the first recording head and the second recording head has been mounted and for indicating a result of detection.

Because the memory medium stores a computer program including the recording head detection program for detecting which one of the first recording head and the second recording head has been mounted and for indicating the detection result, the memory medium can realize the recording apparatus described above.

More specifically, the recording apparatus is controlled by a CPU provided in the recording apparatus or a computer connected to the recording apparatus as described later in conjunction with a preferred embodiment of the invention. Therefore, the recording apparatus can be realized by providing the above-described memory medium, in the form of a ROM or CD, for example for the CPU, or installing the computer program from the memory medium into the computer.

According to still another aspect of the invention, there is provided a recording apparatus including a first recording head capable of recording in black on a recording medium, and a second recording head capable of recording in black on the recording medium at a recording speed that is lower than the recording speed of the first recording head, the second recording head and the first recording head being interchangeably mountable in the recording apparatus. The recording apparatus further includes a reception device that receives information via a communication device, so that the information received is recorded on the recording medium by using one of the first recording head and the second recording head, a detection device that detects which one of the first recording head and the second recording head is mounted, and a storage device that, if the detection device detects that the second recording head is mounted, stores the information received by the reception device.

In the recording apparatus, the detection device detects which one of the first recording head and the second recording head is mounted in the recording apparatus. If the detection device detects that the second recording head has been mounted, the storage device stores the information received by the reception device.

Therefore, the recording apparatus does not record information received from the external device but stores the information into the storage device when the second recording head has been mounted. After the second recording head is replaced by the first recording head having a higher black recording speed, the recording apparatus can record the information, for example, facsimile data, stored in the storage device.

The recording apparatus may further include a recording device that, if the detection device detects that the first recording head is mounted, reads the information from the storage device and records the information by using the first recording head.

Therefore, if the information received by the reception device is not recorded but stored in the storage device because the second recording head has been mounted, the provision of the recording device avoids an undesired event that a user forgets to record the received and stored information. That is, when the detection device detects that the second recording head is replaced with the first recording head, the recording device automatically reads the information from the storage device and records the information by using the first recording head.

According to a further aspect of the invention, there is provided a recording apparatus including a first recording head capable of recording in black on a recording medium, and a second recording head capable of recording in black on the recording medium at a recording speed that is lower than a recording speed of the first recording head, the second recording head and the first recording head being interchangeably mountable in the recording apparatus. The recording apparatus further includes a reception device that receives information via a communication device, so that the information received is recorded on the recording medium by using one of the first recording head and the second recording head, and a detection device that detects which one of the first recording head and the second recording head is mounted, and a changing device that causes an external device transmitting the information to the recording apparatus to change an information transmitting performance of the external device in accordance with the recording speed of a recording head that is detected by the detection device.

In the recording apparatus, the detection device detects which one of the first recording head and the second recording head is mounted in the recording apparatus. The changing device causes an external device transmitting the information to the recording apparatus to change an information transmitting performance of the external device in accordance with the recording speed of a recording head that is detected by the detection device.

In the conventional art, if the transmitting performance of a sender-side apparatus, that is, an external device, is high in comparison with the recording speed of a recording head in a receiver-side apparatus, the receiver-side recording head fails to keep up with the sender-side transmitting performance, thereby causing the sender-side facsimile apparatus to have a transmission error whose cause is unknown to an operating person on the sender side. However, in this invention, the changing device eliminates this problem by changing the transmitting performance of the sender-side apparatus.

The changing device may cause the external device to change a least information transmitting speed of the external device in accordance with the recording speed of the recording head detected by the detection device.

Therefore, the aforementioned problem arising in a case where the recording speed of a receiver-side recording head cannot keep up with the least information transmitting speed of a sender-side apparatus, that is, an external device, can be solved by the changing device changing the least information transmitting speed of the sender-side apparatus in accordance with the receiver-side recording speed.

The changing device may also cause the external device to change an information transmitting speed of the external device in accordance with the recording speed of the recording head detected by the detection device.

Therefore, the aforementioned problem arising in a case where the recording speed of a receiver-side recording head cannot keep up with the information transmitting speed of a sender-side apparatus, that is, an external device, can be solved by the changing device changing the information transmitting speed of the sender-side apparatus in accordance with the receiver-side recording speed.

In the above-described recording apparatuses and the memory medium of the invention, the second recording head may record by ejecting a color ink and a black ink to the recording medium, and the first recording head may record by ejecting a black ink to the recording medium.

The aforementioned conventional problem arises typically in a recording apparatus that interchangeably uses a black recording-dedicated head and a color recording-dedicated head, the latter having a black recording speed that is lower than that of the black recording-dedicated head, as described above. The problem of such a recording apparatus using a black recording-dedicated head and a color recording-dedicated head in an interchangeable manner can be suitably solved by applying the invention.

BRIEF DESCRIPTION OF THE DRAWINGS

A preferred embodiment of the invention will be described in detail with reference to the following figures wherein.

DETAILED DESCRIPTION OF PREFERRED EMBODIMENT

A preferred embodiment of the invention will be described in detail hereinafter with reference to the accompanying drawings.

Figure 1:
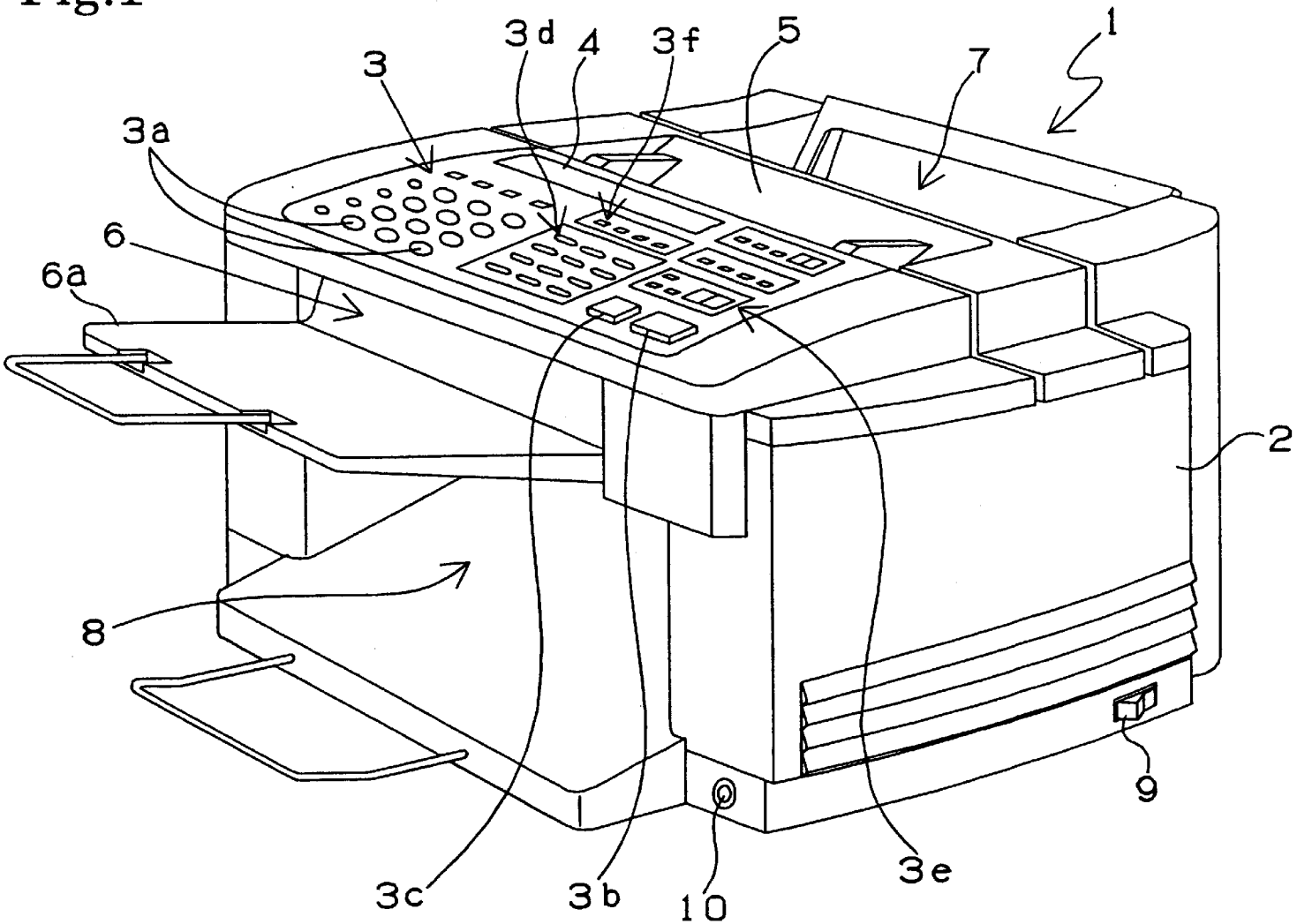
FIG. 1 is an external perspective view of a recording apparatus according a preferred embodiment of the invention.

FIG. 1 is an external perspective view of a recording apparatus according to an embodiment of the invention.

The embodiment will be described with reference to, as a representative recording apparatus, a multi-function type recording apparatus having the various functions of, for example, a facsimile, an image scanner, and a printer.

The recording apparatus 1 has a box-shaped housing 2. An operating panel 3 is provided in an upper forward portion of the housing 2. The operating panel 3 has, for example, "0" to "9" numerical keys 3*a*, a start button 3*b* for instructing start of facsimile data transmission or copying operation, a stop button 3*c* for instructing stop of facsimile data transmission or stop of copying operation, speed call buttons 3*d* for using an abbreviated facsimile number in transmission of facsimile data, mode buttons 3*e* for changing between a facsimile mode and a printer mode, setting buttons 3*f* for setting, for example, a document scanning precision and a copy density.

Provided rearward of the operating panel 3 is a liquid crystal display 4 for displaying a receiver's facsimile number, an operation status, such as a transmission status, a reception status, and a copy status, an indication as to which one of a 4-color recording head and a 6-color recording head has been set, and an indication of received facsimile data being in storage. Formed rearward of the liquid crystal display 4 is a document setting portion 5 for setting a document to be transmitted or copied. A document set in the document setting portion 5 is fed into the housing 2 by a sheet conveying mechanism (not shown) that is provided in the housing 2. A record portion of the document being conveyed is read by an image scanner 45 (see FIG. 4). After the image reading, the document is discharged onto a tray 6*a* in a stackable manner, via a document discharge opening 6 formed below the operating panel 3.

Formed rearward of the document setting portion 5 is a recording sheet setting portion 7 for setting recording sheets on which received facsimile data or print data will be recorded. A recording sheet cassette (not shown) capable of housing a stack of recording sheets is removably attached to the recording sheet setting portion 7. A recording sheet is fed from the recording sheet cassette set in the recording sheet setting portion 7, into the housing 2 by the aforementioned sheet conveying mechanism. During conveyance in the housing 2, the recording sheet is subjected to ink recording performed by a recording head 20 (see FIG. 2). After the recording operation, the recording sheet is discharged via a recording sheet discharge opening 8 formed below the tray 6*a*.

A power switch 9 for turning the recording apparatus 1 on and off is disposed in a lower portion of a right side face of the housing 2. A video input terminal 10 for inputting video signals is provided in a lower right-side portion of a front face of the housing 2.

A handset (not shown) for talking to a facsimile receiver or other receiver is disposed on the left side of the housing 2. A terminal (not shown) for connecting to a communication line is provided in a back face of the housing 2.

The internal structure of the recording apparatus 1 will be described with reference to FIG. 2.

Figure 2:
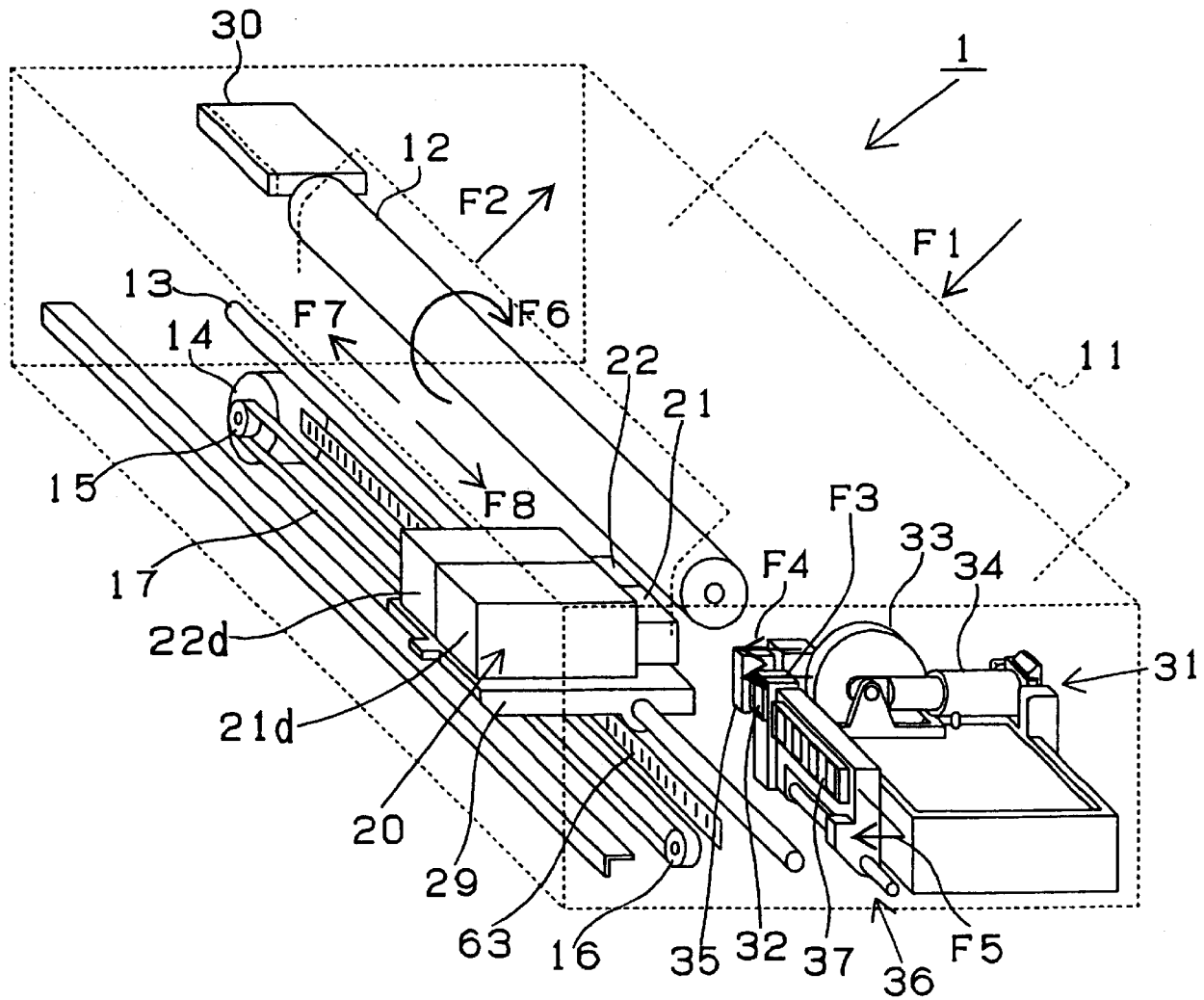
FIG. 2 is an illustration of mechanisms disposed in the recording apparatus, showing a portion for recording on a recording sheet while omitting the image scanner.

FIG. 2 is an illustration of mechanisms disposed in the recording apparatus 1, showing a portion for recording on a recording sheet while omitting the image scanner.

The recording apparatus 1 has a platen roller 12 for receiving a recording sheet 11 fed in a direction indicated by arrow F1 and conveying it in a direction indicated by arrow F2. A carriage shaft 13 extends below the platen roller 12 and parallel to a shaft of the platen roller 12. The carriage shaft 13 supports a carriage 29 on which a recording head 20 is mounted. A carriage motor 14 is disposed below a left-side portion of the carriage shaft 13, and a pulley 16 is disposed below a right-side portion of the carriage shaft 13. A pulley 15 is connected to a rotating shaft of the carriage motor 14. The pulley 15 and the pulley 16 are interconnected by an endless belt 17.

The belt 17 is connected to the carriage 29, so that the carriage 29 is slid along the carriage shaft 13 in directions indicated by arrows F7, F8 when the carriage motor 14 is operated.

The structure of the recording head 20 will be described with reference to FIGS. 3A through 3D.

Figure 3A:
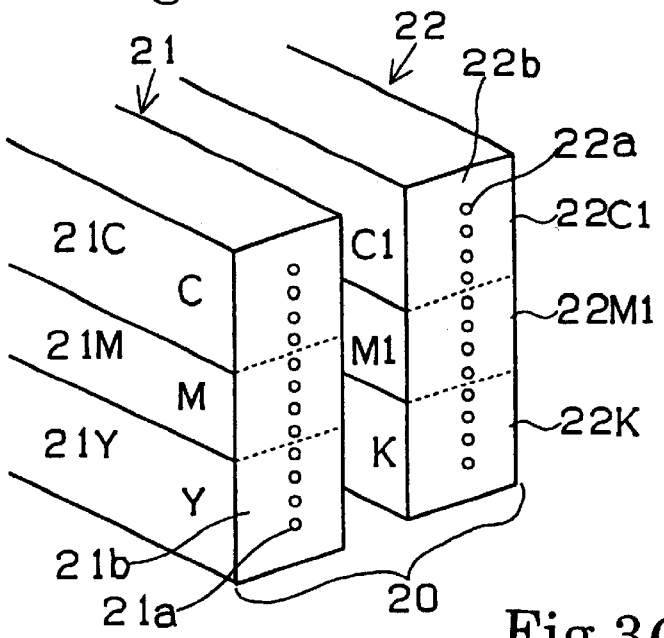
FIG. 3A is an exploded perspective view of a 6-color recording head, taken from the recording surface side.
Figure 3B:
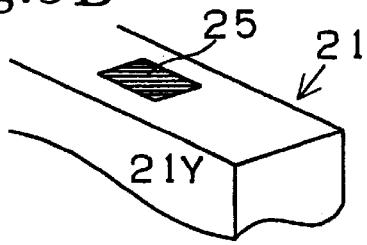
FIG. 3B shows a reverse face of a color head shown in FIG. 3A.
Figure 3C:
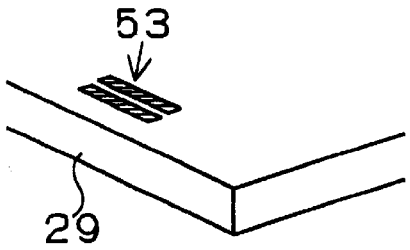
FIG. 3C shows a reverse face of a carriage.
Figure 3D:
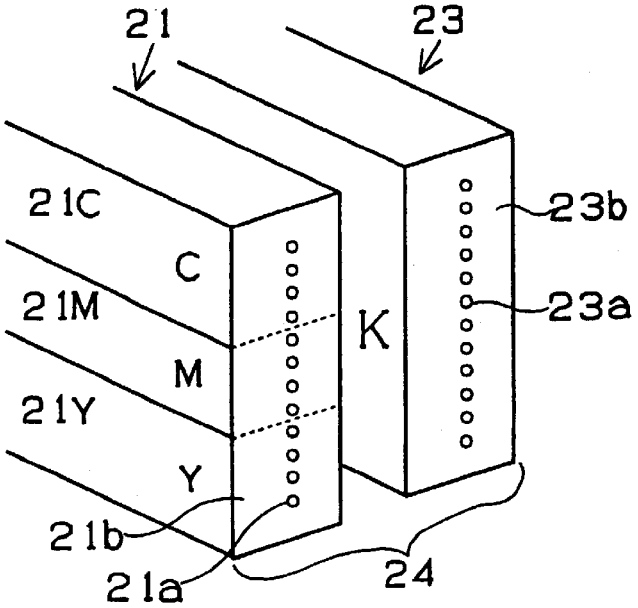
FIG. 3D is an exploded perspective view of a 4-color recording head, taken from the recording surface side.

FIG. 3A is an exploded perspective view of a recording head 20 for use in 6-color ink recording (hereinafter, referred to as "6-color recording head") taken from the recording surface side. FIG. 3B shows a reverse face of a color head 21 shown in FIG. 3A. FIG. 3C shows a reverse face of the carriage 29. FIG. 3D is an exploded perspective view of a recording head 24 for use in 4-color ink recording (hereinafter, referred to as "4-color recording head") taken from the recording surface side.

In FIGS. 3A and 3D, the number of nozzles shown is less than the actual number of nozzles (for example, 760 nozzles), for easy comparison in the number of nozzles.

The recording head 20 and the recording head 24 are drop-on-demand type ink jet heads, more specifically, shear mode type heads employing, for example, piezoelectric ceramics (e.g., heads described in Japanese Patent Application Laid-open No. SHO 63-247051).

The 6-color recording head 20 includes a color head 21 and a color head 22. The color head 21 is made up of a cyan head 21C for ejecting cyan ink, a magenta head 21M for ejecting magenta ink, and a yellow head 21Y for ejecting yellow ink. The color head 22 is made up of a light cyan head 22Cl for ejecting light cyan ink, a light magenta head 22Ml for ejecting light magenta ink, and a black head 22K for ejecting black ink.

The color head 21 has a nozzle plate 21*b* having a plurality of nozzles 21*a* arranged in vertical directions. The nozzles 21*a* are separated for the cyan head 21C, the magenta head 21M and the yellow head 21Y. The color head 22 has a nozzle plate 22*b* having a plurality of nozzles 22*a* arranged in vertical directions. The nozzles 22*a* are separated for the light cyan head 22Cl, the light magenta head 22Ml and the black head 22K.

An electrode 25 is provided on the reverse surface of the color head 21 as shown in FIG. 3B. A head detecting switch 53 formed by a pair of electrodes that is turned on (short-circuited) by the electrode 25 is provided at a site on an upper surface of the carriage 29, the site facing the electrode 25 when the 6-color recording head 20 is mounted on the carriage 29.

That is, when the 6-color recording head 20 is mounted on the carriage 29, the head detecting switch 53 is turned on. A switching signal from the head detecting switch 53 is detected by a CPU 40. In this manner, the CPU 40 determines that the 6-color recording head 20 has been mounted on the carriage 29.

The head detecting switch 53 and the electrode 25 correspond to a detection device in the invention.

Although the embodiment employs the electrode 25 and the head detecting switch 53 as a head detecting device, the head detecting device may also be provided by forming a recess or a protrusion at a predetermined site in the 6-color recording head 20 and disposing on the carriage 29 a switch that is operated by the recess or protrusion of the 6-color recording head 20. Such a detecting device may also be applied to a combination of the 4-color recording head 24 and the carriage 29 so that it can be determined whether the 4-color recording head 24 has been mounted on the carriage 29, that is, whether the 6-color recording head 20 has been removed from the carriage 29.

The 4-color recording head 24 includes a black-dedicated head 23 and a color head 21 that is substantially identical to the color head 21 of the 6-color recording head 20. The black-dedicated head 23 is a black ink-dedicated head that ejects only black ink from each nozzle. The black-dedicated head 23 has a nozzle plate 23*b* having a plurality of nozzles 23*a* arranged in vertical directions.

In the 6-color recording head 20 shown in FIG. 3A, the number of nozzles for ejecting black ink, that is, the number of nozzles provided in the black head 22K, is represented as four (although in reality there are many more). In the 4-color recording head 24 shown in FIG. 3D, the number of nozzles for ejecting black ink, that is, the number of nozzles provided in the black head 23, is represented as twelve.

As indicated by the different representative numbers of the nozzles for ejecting black ink, the 4-color recording head 24 has a greater recording speed in black ink jet recording than the 6-color recording head 20.

Each of the nozzles 21*a*, 22*a*, 23*a* is in communication with an ink chamber formed in the head. Upon a drive signal from a head driver IC 58 (see FIG. 4), walls of an ink chamber formed from a piezoelectric material are deformed so as to change the capacity of the ink chamber, an ink droplet is ejected from the nozzle connected to the ink chamber. As shown in FIG. 2, ink cartridges 21*d*, 22*d* for supplying inks to the ink chambers are replaceably connected to rear portions of the color heads 21, 22.

The recording head 24 corresponds to a first recording head in the invention, and the recording head 20 corresponds to a second recording head.

Referring back to FIG. 2, a linear-type timing slit array 63 extends below and parallel to the carriage shaft 13. An encoder sensor 59 (see FIG. 4) for detecting intervals between slits formed in the timing slit array 63 and outputting a pulse signal corresponding to the position of the carriage 29 is disposed in a lower portion of a front face of the carriage 29. Based on the pulse signal from the encoder sensor 59, the CPU 40 controls the moving speed of the carriage 29.

An ink absorbing pad 30 for absorbing ink ejected from the color heads 21, 22 at a time of flushing, performed in order to recover the ink ejecting function of the nozzles, is disposed near the left-side end of the platen roller 12. A purge device 31 for recovering the ink ejecting function by sucking degraded inks from the nozzles of the color heads 21, 22 is disposed near the right-side end of the platen roller 12. The purge device 31 has a suction cap 32 for covering the nozzle plates 21*b*, 22*b* of the heads 21, 22, a cam 33 for moving the suction cap 32 in a direction indicated by arrow F3, and a pump 34 for achieving a negative pressure in the suction cap 32.

A wiper member 35 for wiping ink or foreign objects from the nozzle plates 21*b*, 22*b* of the color heads 21, 22 after a purging operation is disposed to the left of the suction cap 32. A capping device 36 for preventing the nozzles 21*a*, 22*a* from drying is disposed to the right of the suction cap 32. When the recording head 20 is returned to the home position, the capping device 36 moves a cap 37 in a direction indicated by arrow F5 and to cover the nozzle plates 21*b*, 22*b* of the color heads 21, 22 of the recording head 20. The above description has used the second record head 20, however the operation is the same if the first recording head 24 is mounted on the carriage 20.

Figure 4:
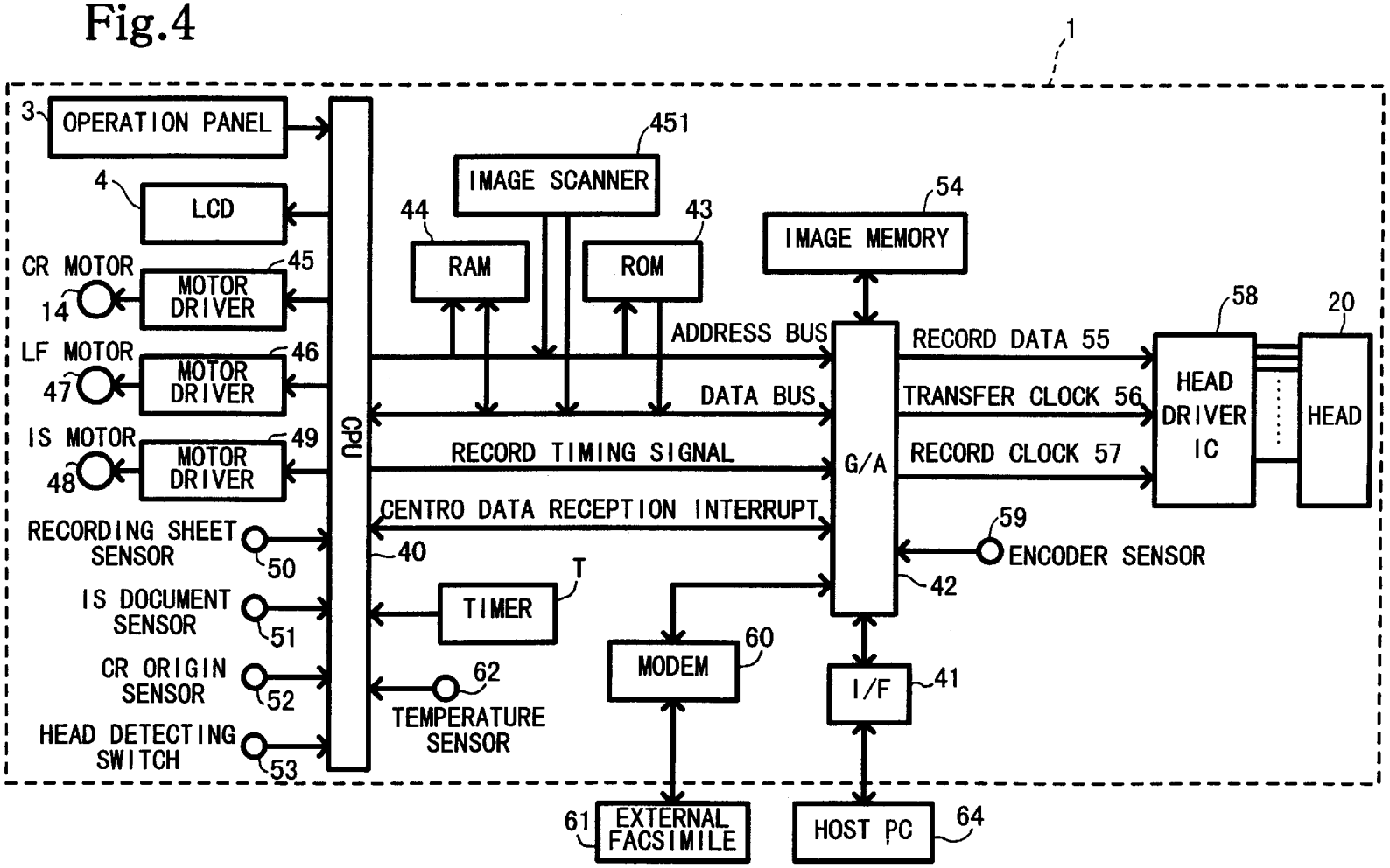
FIG. 4 is a block diagram illustrating the structure of a main control system of the recording apparatus shown in FIG. 1.

Although not shown in FIG. 2, the recording apparatus 1 further has an image scanner 45 for reading image information from a document, an image scanner motor (IS motor) 48 for feeding a document to and conveying it from the image scanner 45, a communication modem 60 for demodulating facsimile data from an external facsimile apparatus 61 and modulating data read by the image scanner 45 and sending the modulated data to the external facsimile apparatus 61, as indicated in the block diagram in FIG. 4, which illustrates the control system of the recording apparatus 1.

The structure of the main control system of the recording apparatus 1 will be described with reference to the block diagram of FIG. 4.

The recording apparatus 1 is equipped with the CPU 40 for controlling the communication with the external facsimile 61, detecting replacement of a recording head, and performing various other controls (described below) based on the detection of recording head replacement.

The recording apparatus 1 further has a gate array 42 for developing facsimile data received via the communication modem 60, facsimile data stored in a RAM 44, or print data inputted from a host computer 64 via an interface 41.

An address bus and a data bus connecting the CPU 40 and the gate array 42 are also connected to a ROM 43 storing various control programs executed by the CPU 40, and to the RAM 44 for storing receiver's facsimile numbers, record data and/or facsimile data inputted to the gate array 42. Therefore, the CPU 40 outputs necessary data to and inputs such data from the RAM 44 or the ROM 43.

As shown in FIG. 4, the gate array 42 is connected to an image memory 54 for temporarily storing received data as image data, and to the encoder sensor 59 for measuring the moving speed of the carriage 29 and determining the recording timing. The gate array 42 generates a record clock 57 based on a signal inputted from the encoder sensor 59 as the carriage 29 moves. The gate array 42 is also connected to the head driver IC 58. The head driver IC 58 operates to drive the recording head 20, on the basis of the record clock 57, a transfer clock 56 and record data 55 inputted from the gate array 42.

The CPU 40 is also connected to a recording sheet sensor 50 for detecting the presence or absence of a recording sheet 11, an image scanner document sensor 51 for detecting the presence of a document adjacent to a reader portion of the image scanner 45, a carriage origin sensor 52 for detecting the presence of the carriage 29 at the home position, the head detecting switch 53 for detecting the 6-color recording head 20 mounted on the carriage 29, a first motor driver 50 for driving the carriage motor 14, a second motor driver 46 for driving a line feed motor 47 that rotates the platen roller 12, a third motor driver 49 for driving an image scanner motor 48, the operating panel 3 for inputting various signals to the CPU 40, and the liquid crystal display 4.

Various controls performed by the CPU 40 will be described with reference to FIGS. 5 through 10.

Figure 5:
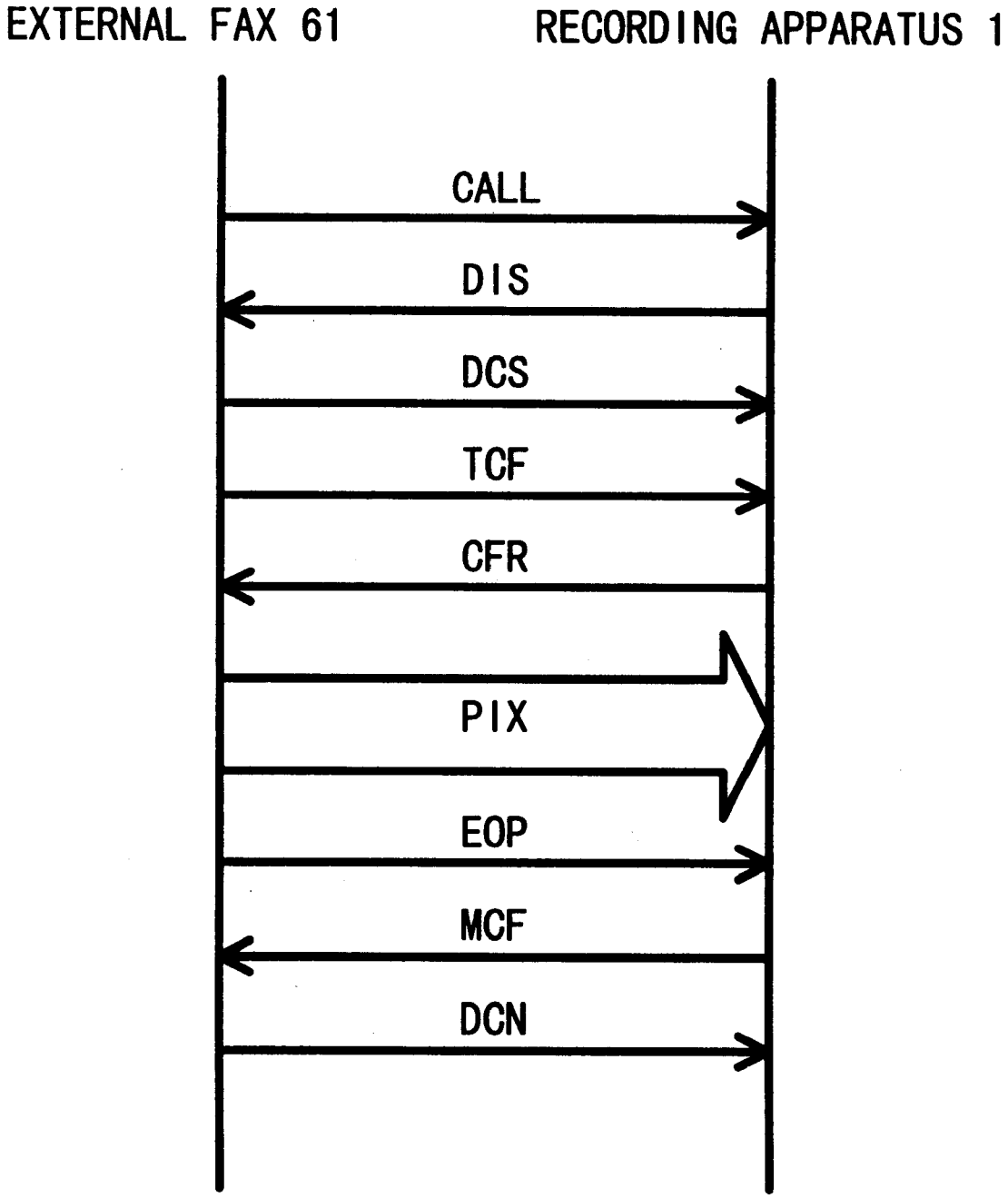
FIG. 5 illustrates a communication procedure performed between the recording apparatus and an external facsimile.
Figure 6:
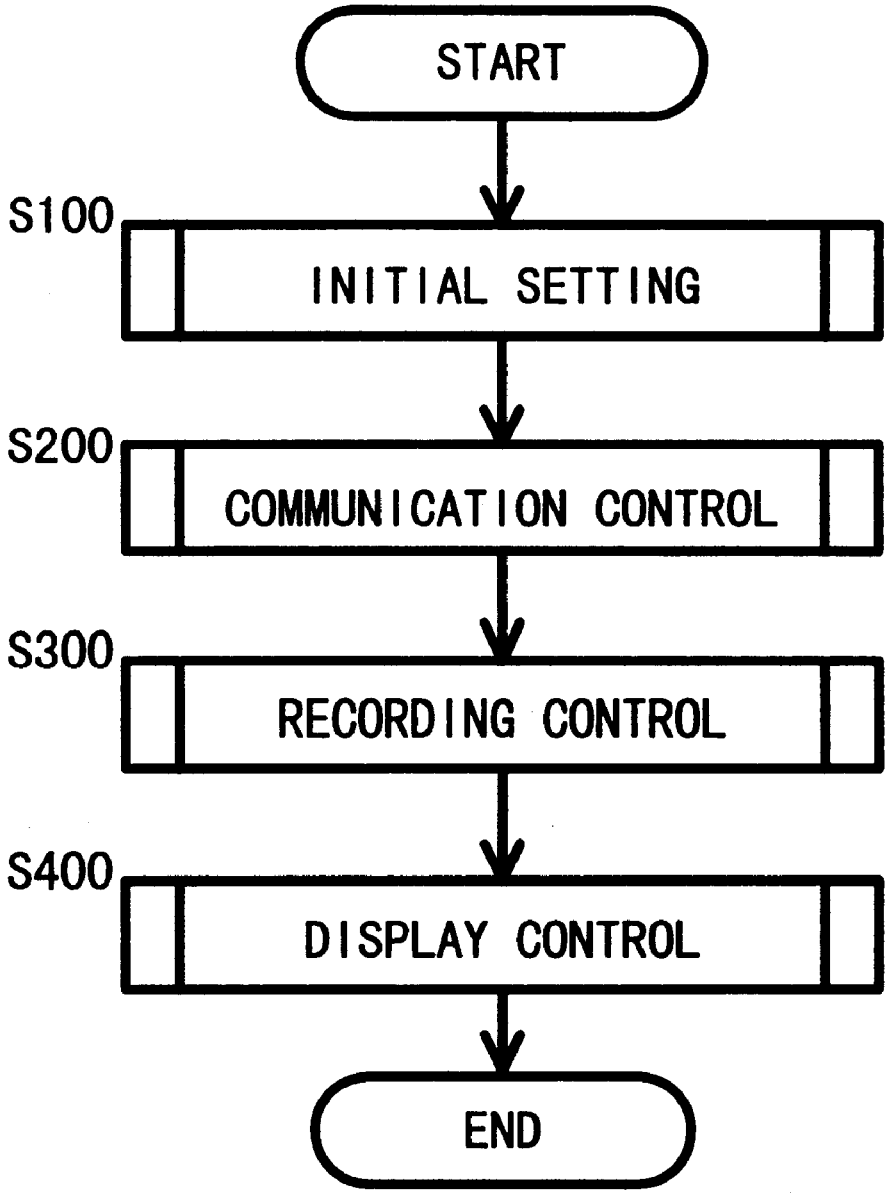
FIG. 6 is a main flowchart illustrating a main control performed by a CPU.
Figure 7:
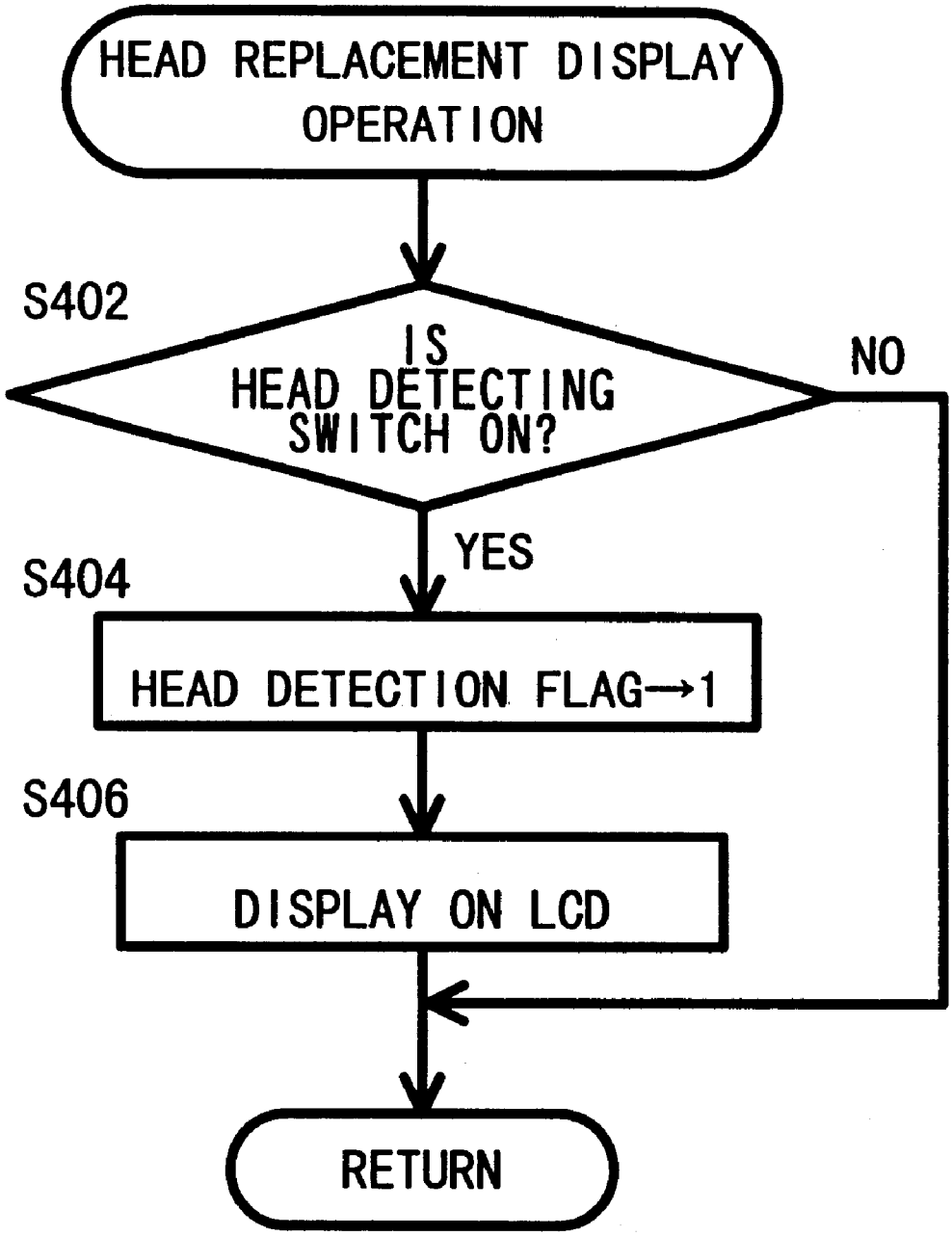
FIG. 7 is a flowchart illustrating a head replacement display operation performed during a display control in step 400 in FIG. 6.
Figure 8:
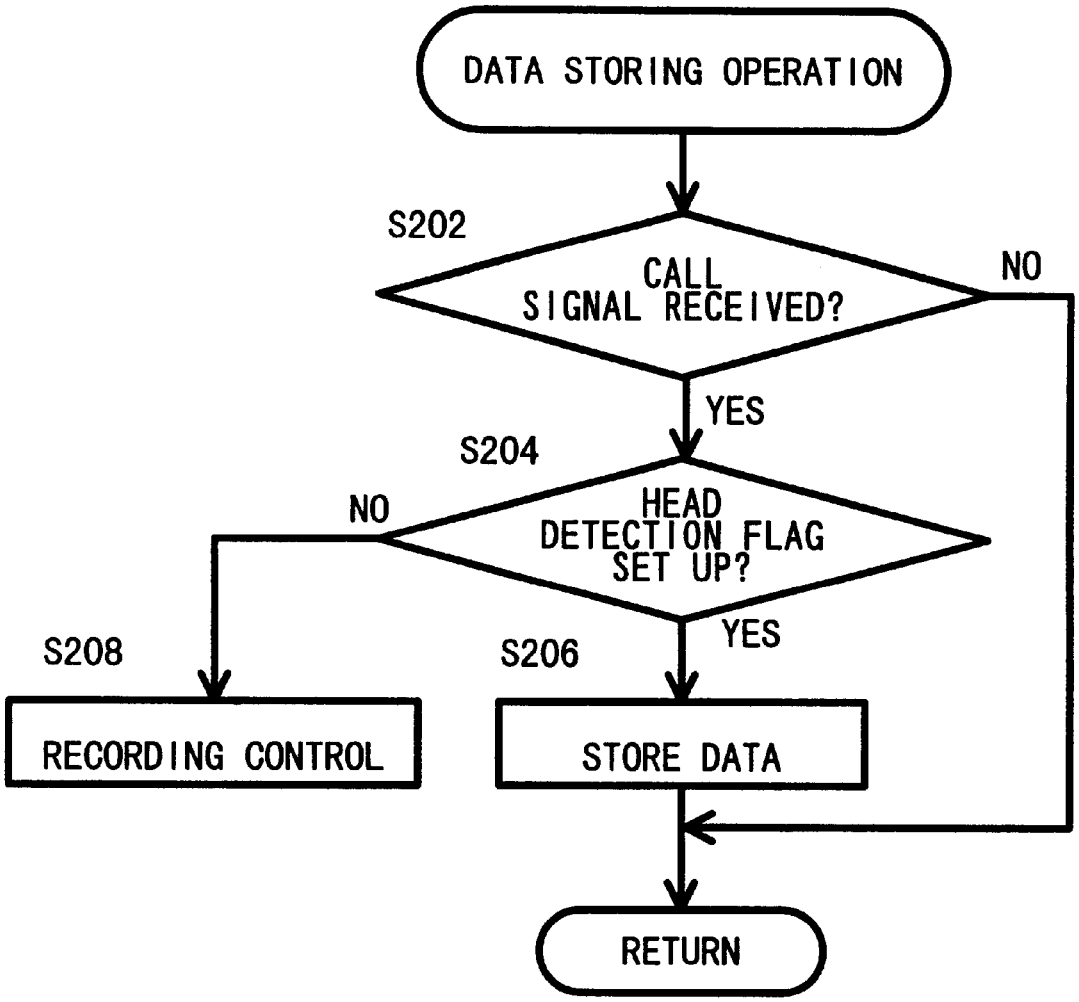
FIG. 8 is a flowchart illustrating a data storing operation performed during a communication control in step 200 in FIG. 6.
Figure 9:
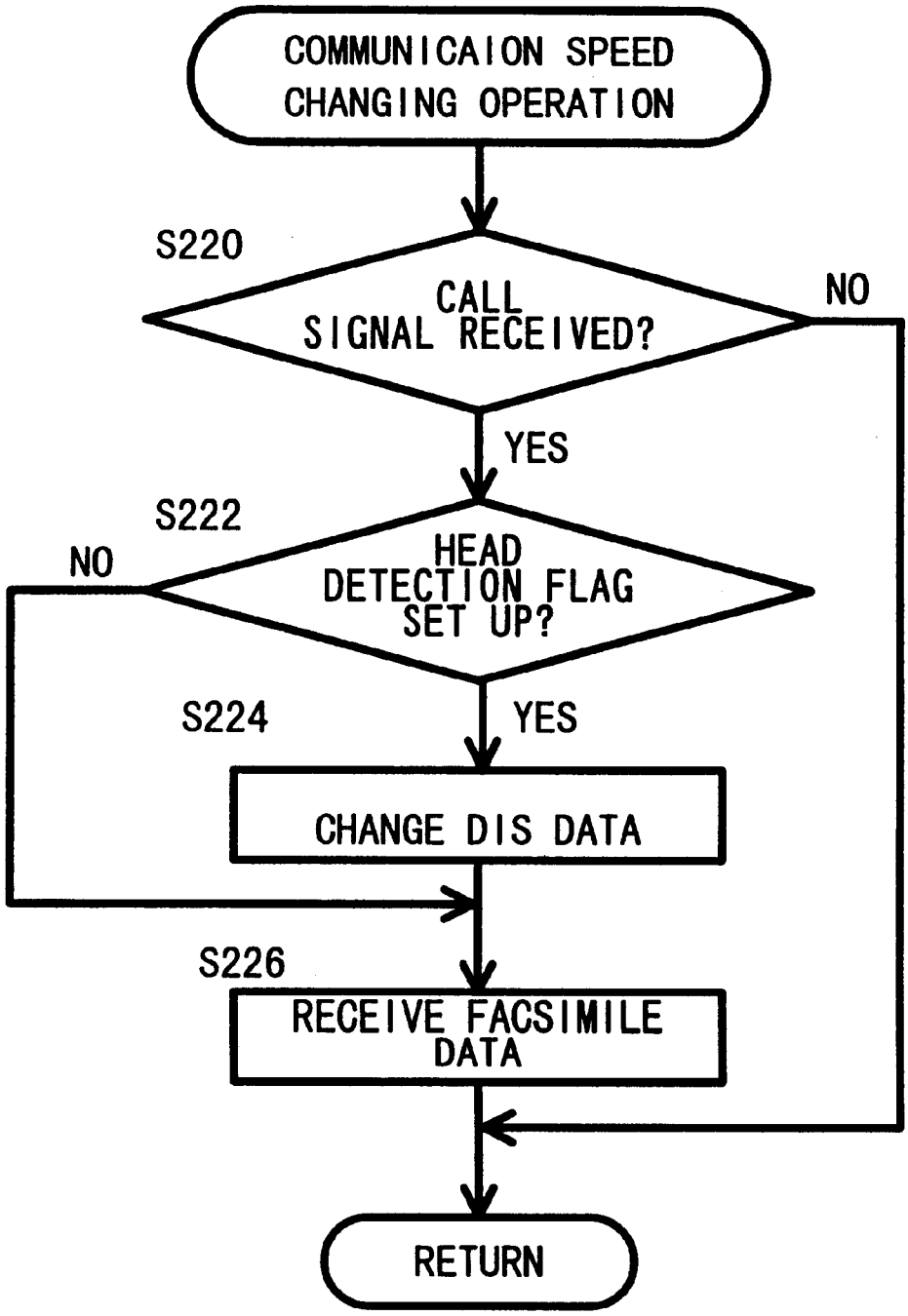
FIG. 9 is a flowchart illustrating a communication speed changing operation performed in the communication control in step 200 in FIG. 6.
Figure 10:
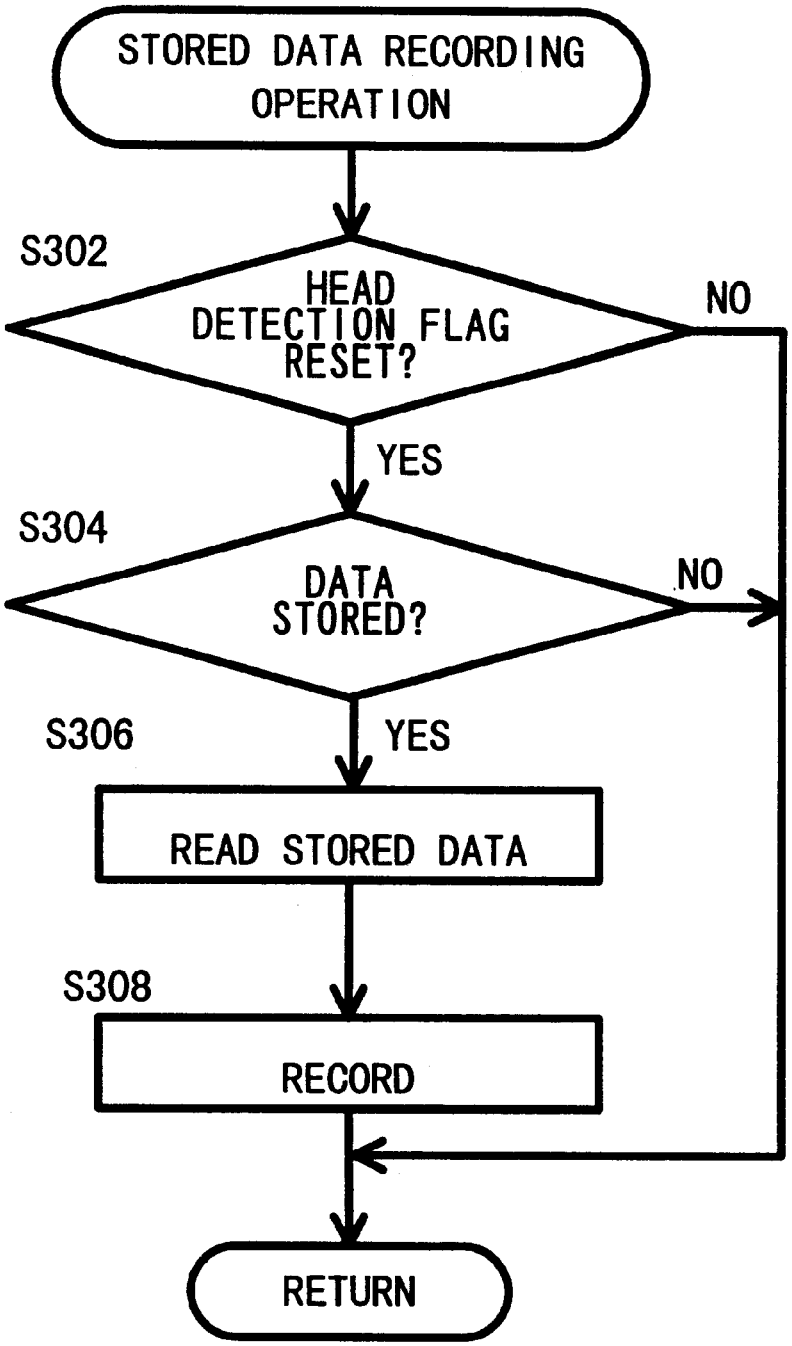
FIG. 10 is a flowchart illustrating a stored data recording operation performed during a recording control in step 300 in FIG. 6.

FIG. 5 is a diagram illustrating a communication procedure performed by the recording apparatus 1 and the external facsimile 61 when the recording apparatus 1 receives facsimile data from the external facsimile 61. FIG. 6 is a main flowchart illustrating the content of a main control performed by the CPU 40. FIG. 7 is a flowchart illustrating the content of a head replacement display operation performed during display control in step 500 in the flowchart of FIG. 6. FIG. 8 is a flowchart illustrating the content of a data storing operation performed during communication control in step 200 in FIG. 6. FIG. 9 is a flowchart illustrating the content of a communication speed changing operation performed during the communication control in step 200 in FIG. 6. FIG. 10 is a flowchart illustrating the content of a stored data recording operation performed during recording control in step 300 in FIG. 6.

The content of the main control performed by the CPU 40 will first be described with reference to FIG. 6.

When the power switch 9 of the recording apparatus 1 is turned on and the CPU 40 detects the powered-on state, the CPU 40 performs initial setting in step 100. After the initial setting, the CPU 40 performs communication control with regard to telephone communication, facsimile communication with the external facsimile 61, or other communications functions incorporated into the recording apparatus in step 200; performs recording control, such as the recording of facsimile data from the external facsimile 61 onto a recording sheet 11 or the recording of print data from the host computer 64 onto a recording sheet 11 in step 300; and then performs display control for displaying the aforementioned various pieces of information in the liquid crystal display 4 in step 400, in accordance with the present needs.

The computer programs necessary for the CPU 40 to perform the aforementioned controls are stored in the ROM 44. The ROM 44 corresponds to a memory medium in the invention.

The head replacement display operation performed by the CPU 40 will be described with reference to FIG. 7.

In step 402, the CPU 40 determines whether the 6-color recording head 20 has been mounted on the carriage 29, on the basis of whether the head detecting switch 53 provided in the carriage 29 has been turned on by the electrode 25 provided on the reverse surface of the color head 21. If the determination in step 402 is affirmative (YES), the operation proceeds to step 404, in which the CPU 40 sets a head detection flag to indicate that the 6-color recording head 20 has been mounted on the carriage 29. Subsequently in step 406, the CPU 40 displays a message, for example, "6-COLOR RECORDING HEAD PRESENTLY SET", on the liquid crystal display 4.

Through the head replacement display operation, the CPU 40 is able to indicate whether the 6-color recording head 20 has been set. Therefore, it is possible to remind a user to replace the 6-color recording head 20 with the 4-color recording head 24 before the recording apparatus 1 receives facsimile data from the external facsimile 61.

Consequently, the recording apparatus 1 avoids an undesired event that the 6-color recording head 20 having a slow black recording speed fails to keep up with the transmission speed of the external facsimile 61 so that the external facsimile 61 has a communication error whose cause is unknown to the operator of the external facsimile 61.

The aforementioned message may also be displayed on a display device (not shown), such as a CRT, that is connected to the host computer 64.

It is also possible to provide a light-emitting diode (LED) that turns on, if the 6-color recording head is mounted, at a predetermined location on a surface of the recording apparatus 1.

Furthermore, it is also possible to indicate that the 6-color recording head has been mounted, by outputting a sound, for example, a "piii" sound, or a voice message "The 6-color recording head is presently set".

The operation performed in step 402 by the CPU 40 functions as a detection device, and the operation in step 406 functions as an indication device.

The data storing operation performed by the CPU 40 will be described with reference to FIG. 8.

In step 202, the CPU 40 determines whether a CALL signal (see FIG. 5) has been received from the external facsimile 61. If the determination is affirmative (YES), the operation proceeds to step 204, in which the CPU 40 determines whether the head detection flag has been set by the operation in step 404 in FIG. 7. If it is determined that the head detection flag has been set (YES in step 204), the CPU 40 receives facsimile data (indicated by PIX in FIG. 5) from the external facsimile 61, and stores the received facsimile data into the RAM 44 in step 206. Conversely, if it is determined in step 204 that the head detection flag has not been set (NO in step 204), the CPU 40 performs the recording control for immediately recording the received facsimile data in step 208.

Through the above-described data storing operation, the CPU 40 can store facsimile data from the external facsimile 61 into the RAM 44 without recording the data, if the 6-color recording head 20 is mounted. Therefore, the facsimile data stored in the RAM 44 can be recorded after the 6-color recording head 20 is replaced with the 4-color recording head 24 having a high black recording speed.

The facsimile data received from the external facsimile 61 may also be stored by using a hard disk drive, a CD-RAM drive or other recordable memory device built in the host computer 64, or an external recordable storage device connected to the host computer 64, for example, a hard disk drive, a CD-RAM drive, or a MO drive.

The RAM 44, the hard disk drive, the CD-RAM drive, or the MO drive corresponds to a storage device in the invention. The operation performed in step 204 by the CPU 40 functions as a detection device, and the operation performed in step 206 functions as a storage device.

The stored data recording operation performed by the CPU 40 will be described with reference to FIG. 10.

In step 302, the CPU 40 determines whether the head detection flag has been reset, that is, whether the 6-color recording head 20 has been replaced with the 4-color recording head 24. If the determination in step 302 is affirmative (YES), the CPU 40 determines in step 304 whether facsimile data has been stored in the RAM 44. If it is determined that facsimile data has been stored (YES in step 304), the CPU 40 reads the facsimile data from the RAM 44 in step 306, and records the facsimile data on a recording sheet 11 using the 4-color recording head 24 in step 308.

Through the above-described stored data recording operation, facsimile data received from the external facsimile 61 and stored in the RAM 44, if any is received and stored, is automatically recorded onto a recording sheet 11 by the 4-color recording head 24 when the 6-color recording head 20 is replaced with the 4-color recording head 24.

Therefore, the operation avoids an undesired event that a user forgets to record the facsimile data stored in the RAM 44 onto a recording sheet 11 in a case where the recording apparatus 1 performs a control operation of temporarily storing received facsimile data into the RAM 44 instead of immediately recording the facsimile data onto a recording sheet 11 while the 6-color recording head 20 is set.

The operation performed in steps 302 through 308 by the CPU 40 functions as a recording device in the invention.

The communication speed changing operation performed by the CPU 40 will be described with reference to FIG. 9.

In step 220, the CPU 40 determines whether the CALL signal (see FIG. 5) is received from the external facsimile 61. If the determination in step 220 is affirmative (YES), the operation proceeds to step 222, in which the CPU 40 determines whether the head detection flag has been set by the operation of step 404 in FIG. 7. If it is determined that the head detection flag has been set (YES in step 222), the CPU 40 sends a data change indicating a communication speed among the data constituting a DIS signal, that is, a signal for indicating the communication ability or performance of the recording apparatus 1 to the external facsimile 61 in step 224.

If the communication speed has been set to, for example, 14.4 Kpbs, the communication speed is changed to 9.6 Kbps.

After receiving the DIS signal from the recording apparatus 1, the external facsimile 61 detects the communication speed indicated in the DIS signal, and transmits to the recording apparatus 1 a DCS signal to indicate that the external facsimile 61 is going to transmit facsimile data at the detected communication speed. Subsequently, the external facsimile 61 transmits to the recording apparatus 1 a TCF signal to check the status of a transmission path. Upon receiving from the recording apparatus 1 a CFR signal that permits transmission, the external facsimile 61 transmits the facsimile data (indicated as PIX in FIG. 5) to the recording apparatus 1. In step 226, the recording apparatus 1 receives the thus-transmitted facsimile data.

Therefore, if the CALL signal is received from the external facsimile 61 when the 6-color recording head 20 has been set, the above-described communication speed changing operation reduces the speed of transmission by the external facsimile 61, by changing the communication speed-indicating data among the data in the DIS signal to data indicating a reduced communication speed.

Consequently, the recording apparatus 1 is able to avoid an undesired event that the 6-color recording head 20 having a low black recording speed fails to keep up with the transmission speed of the external facsimile 61 and therefore causes the external facsimile 61 to have a communication error whose cause is unknown to an operator of the external facsimile 61.

The operation performed in step 222 by the CPU 40 functions as a detection device in the invention. The operation performed in step 224 by the CPU 40 functions as a changing device in the invention.

Although in the above-described communication speed changing operation, the communication speed of the external facsimile 61 is reduced, it is also possible to reduce a least transmission speed, that is, a speed for transmitting a line of facsimile data, of the external facsimile 61, by changing the data indicating the least transmission speed among the data constituting the DIS signal to data indicating a reduced least transmission speed.

Although in the foregoing embodiment, the controls and operations illustrated by the flowcharts of FIGS. 6 through 10 are performed by the CPU 40 contained in the recording apparatus 1, the controls and operations may also be performed by the host computer 64 if a CD-ROM or a floppy disk storing the computer programs for the controls and operations is driven by the host computer 64 so that the computer programs are installed in the host computer 64. In this case, the CD-ROM or the floppy disk functions as a memory medium in the invention.

As understood from the foregoing description, the detection device of a recording apparatus according to the invention detects which one of the first recording head for recording in black on a recording medium and the second recording head for recording in black on a recording medium at a recording speed that is lower than a recording speed of the first recording head is set in the recording apparatus. The result of the detection performed by the detection device is indicated by the indication device. By the indication provided by the indication device, a user of the recording apparatus can recognize which one of the first and second recording heads is mounted. In the application of the invention to a facsimile apparatus, as for example, if a user knows through the indication device that the second recording head has been set when the facsimile apparatus is about to receive facsimile data, the user can replace the second recording head with the first recording head. Therefore, the invention solves the conventional problem that a low recording speed recording head records facsimile data being received but fails to keep up with the transmission speed, thereby causing the sender facsimile apparatus to have a transmission error whose cause is unknown to an operator of the sender facsimile apparatus.

The memory medium of the invention stores a computer program including a recording head detecting program for detecting which one of the first and second recording heads is set and for indicating the detection result. Therefore, the recording apparatus of the invention can be realized by providing the memory medium in the form of a ROM or the like in the recording apparatus, or installing the computer program from the memory medium into a computer connected to the recording apparatus.

In a recording apparatus according to the invention, the detection device detects which one of the first recording head for recording in black and the second recording head for recording in black on a recording medium is mounted in the recording apparatus. If the detection device detects that the second recording head has been set, the storage device stores the information received by the reception device. Therefore, after the second recording head is replaced with the first recording head having a higher black recording speed, the recording apparatus can record the facsimile data stored in the storage device.

The recording apparatus further includes a recording device that, if the detection device detects that the first recording head is mounted, reads the information from the storage device and records the information by using the first recording head. Therefore, if received information is not recorded but stored in the storage device because the second recording head has been mounted, the recording device automatically records the information by using the first recording head when the detection device detects that the second recording head is replaced with the first recording head. Thus, the provision of the recording device avoids an undesired event that a user forgets to record the received and stored information.

In a recording apparatus according to the invention, the detection device detects which one of the first recording head and the second recording head is mounted in the recording apparatus. The changing device causes an external device transmitting the information to the recording apparatus to change an information transmitting performance of the external device in accordance with the recording speed of a recording head that is detected by the detection device. Therefore, even if the transmitting performance of the external device, that is, a sender-side apparatus, is high in comparison with the recording speed of the recording head mounted in the receiver-side apparatus, the changing device eliminates the problem that the receiver-side recording head fails to keep up with the sender-side transmitting performance and therefore causes the sender-side facsimile apparatus to have a transmission error whose cause is unknown to an operating person on the sender side.

In an embodiment, the changing device causes the external device to change a least information transmitting speed of the external device in accordance with the recording speed of the recording head detected by the detection device. In another embodiment, the changing device causes the external device to change an information transmitting speed of the external device in accordance with the recording speed of the recording head detected by the detection device.

The invention can be suitably applied to a recording apparatus including a second recording head that records by ejecting a color ink and a black ink to the recording medium, and a first recording head that records by ejecting a black ink to the recording medium, since in that combination of recording heads, the second recording head normally has a lower black recording speed that the first recording head.

It is to be understood that the invention is not restricted to the particular forms shown in the foregoing embodiments. Various modifications and alterations can be made thereto without departing from the scope of the invention.

What is claimed is:

1. A recording apparatus, comprising:

a first recording head capable of recording on a recording medium;

a second recording head capable of recording on the recording medium at a recording speed that is lower than a recording speed of the first recording head, the second recording head and the first recording head being interchangeably mountable in the recording apparatus;

a reception device that receives information via a communication device, so that the information received is recorded on the recording medium by using one of the first recording head and the second recording head;

a detection device that detects which one of the first recording head and the second recording head is mounted; and a storage device that, if the detection device detects that the second recording head is set, stores the information received by the reception device.

2. The recording apparatus according to claim 1, wherein the second recording head has less ejection nozzles than the first recording head for recording by ejecting a black ink to the recording medium.

3. The recording apparatus according to claim 2, further comprising a recording device that, if the detection device detects that the first recording head is set, reads the information from the storage device and records the information using the first recording head.

4. The recording apparatus according to claim 3, wherein the second recording head has less ejection nozzles than the first recording head for recording by ejecting a black ink to the recording medium.

5. A recording apparatus, comprising:

a first recording head capable of recording on a recording medium;

a second recording head capable of recording on the recording medium at a recording speed that is lower than a recording speed of the first recording head, the second recording head and the first recording head being interchangeably mountable in the recording apparatus;

a reception device that receives information via a communication device, so that the information received is recorded on the recording medium by using one of the first recording head and the second recording head;

a detection device that detects which one of the first recording head and the second recording head is mounted; and a changing device that causes an external device transmitting the information to the recording apparatus to change an information transmitting performance of the external device in accordance with the recording speed of a recording head that is detected by the detection device.

6. The recording apparatus according to claim 5, wherein the second recording head has less ejection nozzles than the first recording head for recording by ejecting a black ink to the recording medium.

7. The recording apparatus according to claim 5, wherein the changing device causes the external device to change a least information transmitting speed of the external device in accordance with the recording speed of the recording head detected by the detection device, the least information transmitting speed being a speed for transmitting a line of data.

8. The recording apparatus according to claim 7, wherein the second recording head has less ejection nozzles than the first recording head for recording by ejecting a black ink to the recording medium.

9. The recording apparatus according to claim 5, wherein the changing device causes the external device to change an information transmitting speed of the external device in accordance with the recording speed of the recording head detected by the detection device.

10. The recording apparatus according to claim 9, wherein the second recording head has less ejection nozzles than the first recording head for recording by ejecting a black ink to the recording medium.

11. The recording apparatus according to claim 5, wherein the changing device comprises:

a data sending device that sends communication speed indicating data to the external device, the communication speed indicating data indicating a communication speed of the recording apparatus; and a data changing device that changes the communication speed indicating data to data indicating a reduced communication speed in accordance with the recording speed of the recording head that is detected by the detection device, wherein the data sending device sends the data indicating the reduced communication speed changed by the data changing device to the external device.

12. A printing apparatus, associated with a communication device that transmits and receives facsimile messages, having a platen and an opposing carriage for reciprocating movement parallel to the platen, comprising:

a first recording head mountable on the carriage for recording on a recording medium at a recording speed corresponding to a transmission rate;

a second recording head mountable on the carriage for recording on the recording medium at a slower recording speed than the first recording head;

a detection device that detects which of the first recording head and the second recording head is mounted on the carriage; and a controller that directs an action of the printing apparatus to enable receipt of facsimile messages transmitted by a remote facsimile machine and subsequent printing when the second recording head is mounted on the carriage as detected by the detection device.

13. The printing apparatus according to claim 12, further comprising an indication device, wherein the controller directs the indication device to activate thereby alerting a user the second recording head is mounted on the carriage.

14. The printing apparatus according to claim 12, further comprising a storage device, wherein the controller, on a basis of the output of the detection device, stores incoming facsimile data in the storage device when the second recording head is mounted on the carriage.

15. The printing apparatus according to claim 14, further comprising a recovery device controlled by the controller to recall and print the stored incoming facsimile data when the detection device detects the first recording head is mounted on the carriage replacing the second recording head.

16. The printing apparatus according to claim 12, further comprising a transmission rate changing device, wherein the controller directs the transmission rate changing device to send a message to a source of incoming facsimile data to change a speed of data transmission to correspond to a print rate of the second recording head when the second recording head is mounted on the carriage.

17. The print apparatus according to claim 16, wherein the rate changing device sends a transmitting speed message to the source of incoming facsimile data to change the speed of data transmission after receipt of each line of data so long as the detection device detects the presence of the second recording head on the carriage.

18. The printing apparatus according to claim 16, wherein the transmission rate changing device comprises:

a data sending device that sends communication speed indicating data to a source of incoming facsimile data, the communication speed indicating data indicating a communication speed of the printing apparatus; and a data changing device that changes the communication speed indicating data to data indicating a reduced communication speed in accordance with the recording speed of the recording head that is detected by the detection device, wherein the data sending device sends the data indicating the reduced communication speed changed by the data changing device to the source of incoming facsimile data.

19. A memory medium storing a computer program for controlling a printing apparatus, associated with a communication device that transmits and receives facsimile messages, having a platen and an opposing carriage for reciprocating movement parallel to the platen, a first recording head mountable on the carriage for recording on a recording medium at a recording speed corresponding to a transmission rate; a second recording head mountable on the carriage for recording on the recording medium at a slower recording speed than the first recording head; a detection device that detects which of the first recording head and the second recording head is mounted on the carriage; and a controller that directs an action of the printing apparatus using the computer program, the computer program including a sub-program to enable receipt of facsimile messages transmitted by a remote facsimile machine, and a sub-program to control subsequent printing when the second recording head is mounted on the carriage as detected by the detection device.

20. The memory medium according to claim 19, wherein the printing apparatus further includes an indication device, and the computer program further comprising a subprogram that directs the indication device to activate thereby alerting a user the second recording head is mounted on the carriage.

21. The memory medium according to claim 19, wherein the printing apparatus further includes a storage device and a recovery device, and the computer program further comprises a sub-program that based on the output of the detection device, provides for storing incoming facsimile data in the storage device when the second recording head is mounted on the carriage and a sub-program for the recovery device to recall and print the stored incoming facsimile data when the detection device detects the first recording head is mounted on the carriage replacing the second recording head.

22. The memory medium according to claim 19, wherein the printing apparatus further includes a transmission rate changing device, and the computer program further comprises a sub-program that provides for directing the transmission rate changing device to send a message to a source of incoming facsimile data to change a speed of data transmission to correspond to a print rate of the second recording head when the second recording head is mounted on th the carriage.

* * * * *